United States Patent [19]

Weber et al.

[11] Patent Number: 4,487,165

[45] Date of Patent: Dec. 11, 1984

[54] TUBE LANE MANIPULATOR

[75] Inventors: Jakob Weber, Baiersdorf-Hagenau; Josef Forster, Erlangen; Robert Weber, Uttenreuth, all of Fed. Rep. of Germany

[73] Assignee: Kraftwerk Union Aktiengesellschaft, Mulheim, Fed. Rep. of Germany

[21] Appl. No.: 572,174

[22] Filed: Jan. 18, 1984

[30] Foreign Application Priority Data

Jan. 19, 1983 [DE] Fed. Rep. of Germany ..... 3301536

[51] Int. Cl.[3] ..... F22B 37/52

[52] U.S. Cl. ..... 122/392; 15/316 R; 165/95

[58] Field of Search ..... 122/379, 390, 392; 165/95; 317/316 R, 316 A, 317

[56] References Cited

U.S. PATENT DOCUMENTS

| | | | |
|---|---|---|---|
| 2,668,978 | 2/1954 | De Mart | 122/390 X |
| 2,722,033 | 11/1955 | Glihm et al. | 122/392 R |
| 4,229,854 | 10/1980 | Johnston, Jr. | 15/316 R |
| 4,407,236 | 10/1983 | Schukei et al. | 122/390 |
| 4,424,769 | 1/1984 | Charamathieu et al. | 122/392 |
| 4,437,201 | 3/1984 | Zalewski | 15/316 R |

*Primary Examiner*—Edward G. Favors

*Attorney, Agent, or Firm*—Herbert L. Lerner; Laurence A. Greenberg

[57] ABSTRACT

A tube lane manipulator assembly for the high-pressure blowdown of heat exchangers of steam generators includes a manipulator, at least one vehicle disposed on the manipulator having a lower base body with a substantially rectangular cross section, a spraying head with nozzles on the vehicle, the vehicle being insertible into tube lanes of the tubes of the generator through service openings and being movable in the tube lanes by remote control, the spraying head being movable into position for spraying jets into interspaces between the tubes, at least two clamping legs disposed in tandem in the feed direction on a side of the vehicle for clamping the vehicle to the tubes in conformity with a tube pitch in a clamping plane on at least one side of the tube lane for positioning the nozzles in spraying positions, the spraying direction of the nozzles and the distance thereof from the clamping plane being matched to the tube pitch for directing the spray jets into the interspaces, and at least one L-shaped guide rail extended along a feed direction within a tube lane forming an abutment for the clamping legs and a guide for the vehicle, the guide rail having a vertical leg facing away from the first row of tubes and a horizontal leg defining a space between the legs being limited in width by the row of tubes closest to the tube lane for receiving the lower base body.

19 Claims, 7 Drawing Figures

FIG1

TUBE LANE MANIPULATOR

The invention relates to a tube lane manipulator for the high-pressure blowdown of heat exchangers of steam generators, especially for the tube sheet region of steam generators of nuclear power stations, having tubes disposed in rows and spaced apart on a tube grid by a given tube pitch defining interspaces therebetween, tube lanes disposed between the rows of tubes and service openings such as hand holes providing access to the tube lanes, comprising a manipulator, at least one vehicle disposed on the manipulator having a lower base body with a substantially rectangular cross section, a spraying head with nozzles being disposed on the vehicle, the vehicle being insertible into the tube lanes through the service openings and being movable in the tube lanes by remote control in a given feed direction, the spraying head being movable into position for spraying jets directed into the interspaces, at least two extendable and retractable clamping legs disposed in tandem in the feed direction on a side of the vehicle for clamping the vehicle to the tubes in conformity with the tube pitch in a clamping plane on at least one opposite side of a tube lane for positioning the nozzle in respective spraying positions of a spraying position sequence, the spraying direction of the nozzle and the distance thereof from the clamping plane being matched to the tube pitch for directing the spray jets into the interspaces, and a guide rail extended along the feed direction within a tube lane forming an abutment for the clamping legs and a guide for the vehicle. Suction nozzles and lines may be provided for pumping off accumulated blowdown water. Furthermore, the width of the tube lanes is decreased by internal components and/or heat exchanger tubes are accessible for the clamping legs on only one long side of the manipulator.

Such a device is also described in U.S. application Ser. No. 460,859, filed Jan. 25, 1983. The above-mentioned application Ser. No. 460,859 solves the problem of conveniently installing a tube lane manipulator in an operating position, of positioning it during the operating cycle and of disassembling it again after the spraying operation is completed, wherein the positioning in the spraying position and the feed can proceed automatically to a very great extent and observations through a hand hole or by means of suitable television cameras can be limited to sampled checking observations.

However, some steam generators have relatively narrow tube lanes between their tube bundles. U-tube steam generators for pressurized-water nuclear power generating stations are particularly involved here. In such devices the inside width of the tube lane between the two tube bundles is limited immediately above the tube sheet by internal components such as, in particular, tie rods disposed parallel to the tube axis. Such internal components or tie rods are as a rule aligned with each other in the center of the tube lane, so that two tube lane halves with a relatively small inside width are formed.

In U.S. application Ser. No. 460,859, the basic approach to the solution of this problem is already disclosed with regard to how the tube lane manipulator can be constructed in the case of constricted tube lanes. To this end, at least two clamping feed must be provided in tandem in the travel direction of the vehicle on one side of the vehicle for engaging the heat exchanger tubes, and inside the tube lane or, in this case, within the tube lane half, a guide rail aligned in its longitudinal direction or in the feed direction of the manipulator for the vehicle must be installed, which forms the abutment for the clamping legs and a guide for the vehicle in the feed direction.

It is accordingly an object of the invention to provide a tube lane manipulator which overcomes the hereinafore-mentioned disadvantages of the heretofore-known devices of this general type, and to construct the tube lane manipulator including the guide rail in such a manner that the spraying process during the cleaning of the steam generator can be carried out in an effective manner comparable to the tube lane manipulator according to application Ser. No. 460,859, even in the case of narrow tube lanes.

With the foregoing and other objects in view there is provided, in accordance with the invention, a tube lane manipulator assembly for the high-pressure blowdown of heat exchangers of steam generators, especially for the tube sheet region of steam generators of nuclear power stations, having tubes disposed in rows and spaced apart in a tube grid by a given tube pitch defining interspaces therebetween, tube lanes disposed between the rows of tubes and service openings such as hand holes providing access to the tube lanes, comprising a manipulator, at least one vehicle disposed on the manipulator having a lower base body with substantially rectangular cross section, a spraying head with nozzles being disposed on the vehicle, the vehicle being insertible into the tube lanes through the service openings and being movable on the tube lanes by remote control in a given feed direction, the spraying head being movable into position for spraying jets directed into the interspaces, at least two extendable and retractable clamping legs disposed in tandem in the feed direction on a side of the vehicle for clamping the vehicle to the tubes in conformity with the tube pitch in a clamping plane on at least one opposite side of a tube lane for positioning the nozzle in respective spraying positions of a spraying position sequence, the spraying direction of the nozzle and the distance thereof from the clamping plane being matched to the tube pitch for directing the spray jets into the interspaces, and at least one guide rail extended along the feed direction within a tube lane forming an abutment for the clamping legs and a guide for the vehicle, the guide rail having a substantially L-shaped cross section with a vertical leg facing away from the row of tubes closest to the tube lane and a horizontal leg defining a space between the legs being limited in width by the row of tubes closest to the tube lane for receiving the lower base body of the vehicle.

In accordance with another feature of the invention, there are provided internal components decreasing the width of the tube lanes.

In accordance with a further feature of the invention, the manipulator has relatively longer and relatively shorter sides, and the tubes are accessible to the clamping legs from only one long side of the manipulator.

In accordance with an added feature of the invention, there are provided suction nozzles and suction lines for pumping off accumulated blowdown water.

In accordance with an additional feature of the invention, the base body of the vehicle has a lower surface and a surface adjacent the vertical leg of the guide rail, one of the surfaces having projections formed thereon or indentations formed therein and one of the legs of the guide rail having indentations formed therein or projections formed thereon sliding on the projections or indentations, respectively, in the feed direction.

In accordance with again another feature of the invention, the horizontal leg of the guide rail has an upper surface with a longitudinal key having a T-shaped profile integral with the upper surface, and the base body of the vehicle has a lower surface with a longitudinal slot with a T-shaped cross section formed therein and extended over the T-shaped profile.

In accordance with again a further feature of the invention, the base body of the vehicle has a projection integral with an upper region of a lateral surface thereof, the projection being extended over the top of the vertical leg of the guide rail, and the projection having a slot formed therein for sliding on the vertical leg in the feed direction in the form of a slot and key guide.

In accordance with again an added feature of the invention, there are provided internal components dividing the tube lane along a vertical central plane into two tube lane halves, the at least one guide rail being in the form of two guide rails with L-shaped cross sections each being disposed in a respective one of the tube lane halves forming a double rail with vertical legs facing each other, the at least one vehicle being in the form of two identical vehicles each being slideable on a respective one of the guide rails in the feed direction, the clamping legs of the vehicles being extendable away from the central plane laterally outwardly toward the row of tubes closest to the tube lane, and the nozzles of the spraying heads being movable laterally away from the central plane into alignment toward the interspaces of the two tube legs or tube bundle halves.

In accordance with again an additional feature of the invention, the steam generator includes a tube sheet, and the internal components are tie rods disposed in the center of the tube lane, extended parallel to the tubes and anchored in the tube sheet.

In accordance with yet another feature if the invention, the heat exchanger has a wall with an inner surface, the tubes include end tubes, the two guide rails are joined together at an end region thereof to form an elongated U-rail body, as seen from the top, the two guide rails have dogs disposed on outer surfaces of the horizontal legs thereof in the end region facing away from each other, and the dogs have axially parallel fitting surfaces and inclined clamping surfaces, the clamping surfaces being spaced apart by a distance exceeding the width of the tube lane, including a rectangular connecting piece fastened to the vertical legs of the guide rails of the U-rail body in the end region, a clamping device supported by the connecting piece, an adjusting spinle disposed on the clamping device, a pressure piece disposed on a free end of the adjusting spindle, the adjusting spindle being supported in and being able to be screwed in and out of the connecting piece, the U-rail body being insertible into the tube lane from one end thereof resting with the dogs against the end tubes of the two rows of tubes closest to the tube lane and being clampable by tightening the adjusting spindle at the heat exchanger wall between the end tubes and the inner surface of the wall of the heat exchanger, and being movable into a desired position relative to the rows of tubes.

In accordance with yet a further feature of the invention, the pressure piece has a spherical contact surface and is spherically adjustably supported at the free end of the adjusting spindle.

In accordance with yet an added feature of the invention, the U-rail body has an open end, including at least one pair of control surfaces disposed on sides of the horizontal legs facing away from each other in vicinity of the open end of the U-rail body, threaded blocks fastened to the guide rails at the open end of the U-rail body, a coupling plate having an adjusting wedge insertible between the two guide rails, and set screws for tightening the adjusting wedge to the threaded blocks bringing the guide rails into contact with the tubes of the rows of tubes closest to the tube lane with the contact surfaces.

In accordance with yet an additional feature of the invention, there is provided a handle bracket disposed on the coupling plate.

In accordance with still another feature of the invention, the guide rails are cross divided into at least two rail parts, and including a rail joint substantially at the middle of the length of the guide rails, and coupling plates disposed in recesses formed in a lower and a side surface of the guide rails in vicinity of the rail joint.

In accordance with a concomitant feature of the invention, the at least one guide rail is in the form of two guide rails joined together at an end region thereof to form an elongated U-rail body having an open end, the T-shaped profile of the longitudinal key being transformed into a rectangular profile, i.e. the T-legs are omitted, in vicinity of the open end of the U-rail body over at least the length of the vehicle where the manipulator is mounted, whereby the vehicle is mountable on the longitudinal key with the longitudinal slot on the rectangular profile and is slideable onto the T-shaped profile.

The advantages that can be obtained with the invention are seen primarily in the fact that the new manipulator is of very narrow construction and that it is therefore even possible, as mentioned above, to install a guide rail in each respective lane half and to place a manipulator on each respective guide rail, wherein these two tube lane manipulators are then advanced through the tube lane, preferably simultaneously, and each spray to one side at the same time. The performance of this "twin manipulator" can therefore be at least as good as that of the manipulator according to application Ser. No. 460,859, which has a dual spraying head spraying toward both sides, because it has more space available in the tube lane.

Other features which are considered as characteristic for the invention are set forth in the appended claims.

Although the invention is illustrated and described herein as embodied in a tube lane manipulator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
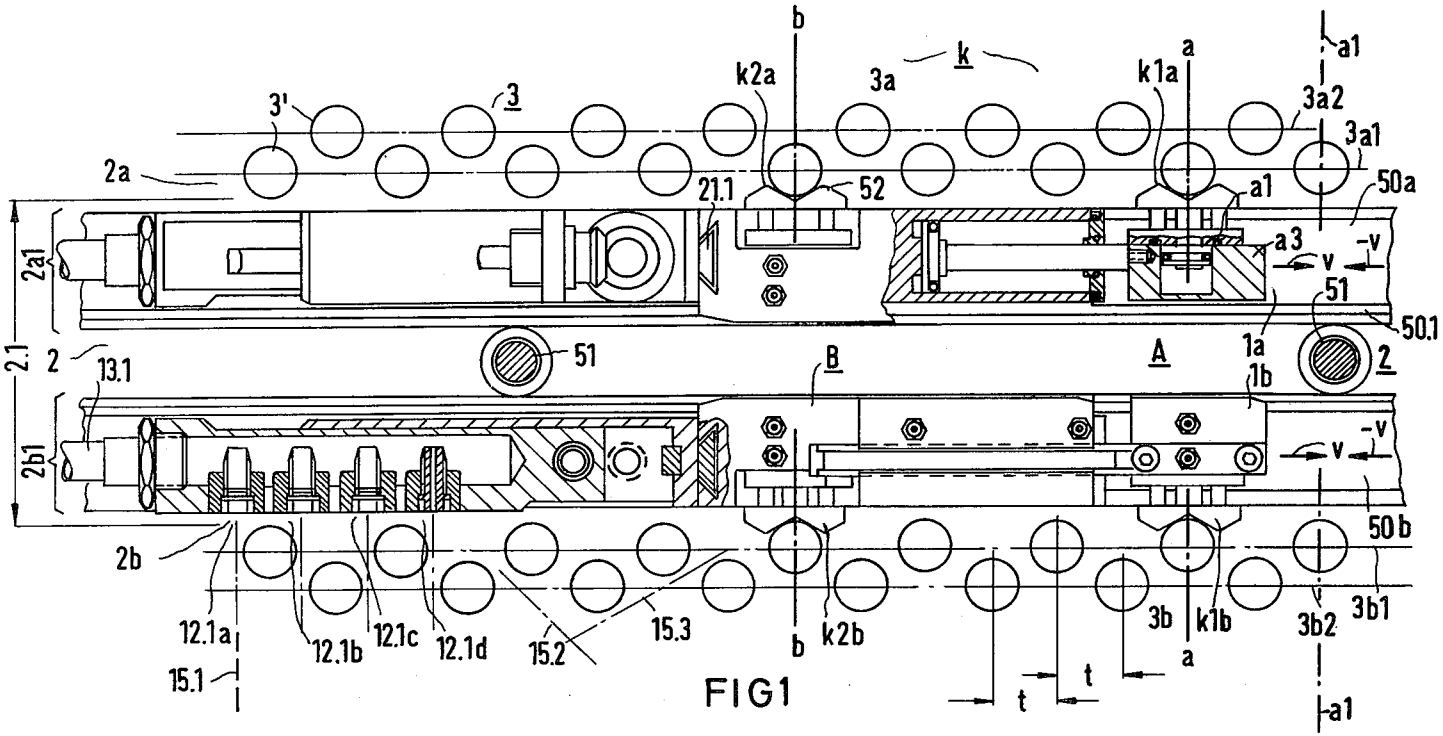
FIG. 1 is a fragmentary, diagrammatic, top-plan view, partly broken away and in cross section of a manipulator according to the invention with the associated guide rails.

Referring now to the figures of the drawing in which the reference symbols from U.S. application Ser. No. 460,859, filed Jan. 25, 1983 are used in the figures as far as possible, and first particularly to FIG. 1 thereof, there is seen a top view of two individual manipulators 1*a* and 1*b* which are of identical construction and can be moved within a tube lane 2 of a U-tube steam generator, on respective longitudinal rails 50*a*, 50*b* parallel to the axis 2' of the tube lane in feed directions v and −v, respectively. For the sake of simplification, only the first two tube rows 3*a*1, 3*a*2 and 3*b*1, 3*b*2 adjacent the tube lane 2 of the two legs 3*a*, 3*b* of the U-tube bundle, are shown. The inside width 2.1 of the tube lane 2 between the first two tube rows 3*a*1, 3*b*1, is not fully available, but is subdivided by tie rods 51 disposed in the center of the tube lane. For this reason two relatively narrow sublanes 2*a*1, 2*b*1 on the tube lane sides 2*a* and 2*b*, respectively, on both sides of the tie rods 51 or on both sides of a vertical axis of symmetry envisioned as passing through the longitudinal axis 2', are obtained. The tubes of the U-tube bundle are designated as a whole with reference numeral 3 and are designated individually with reference numeral 3'.

Figure 2:
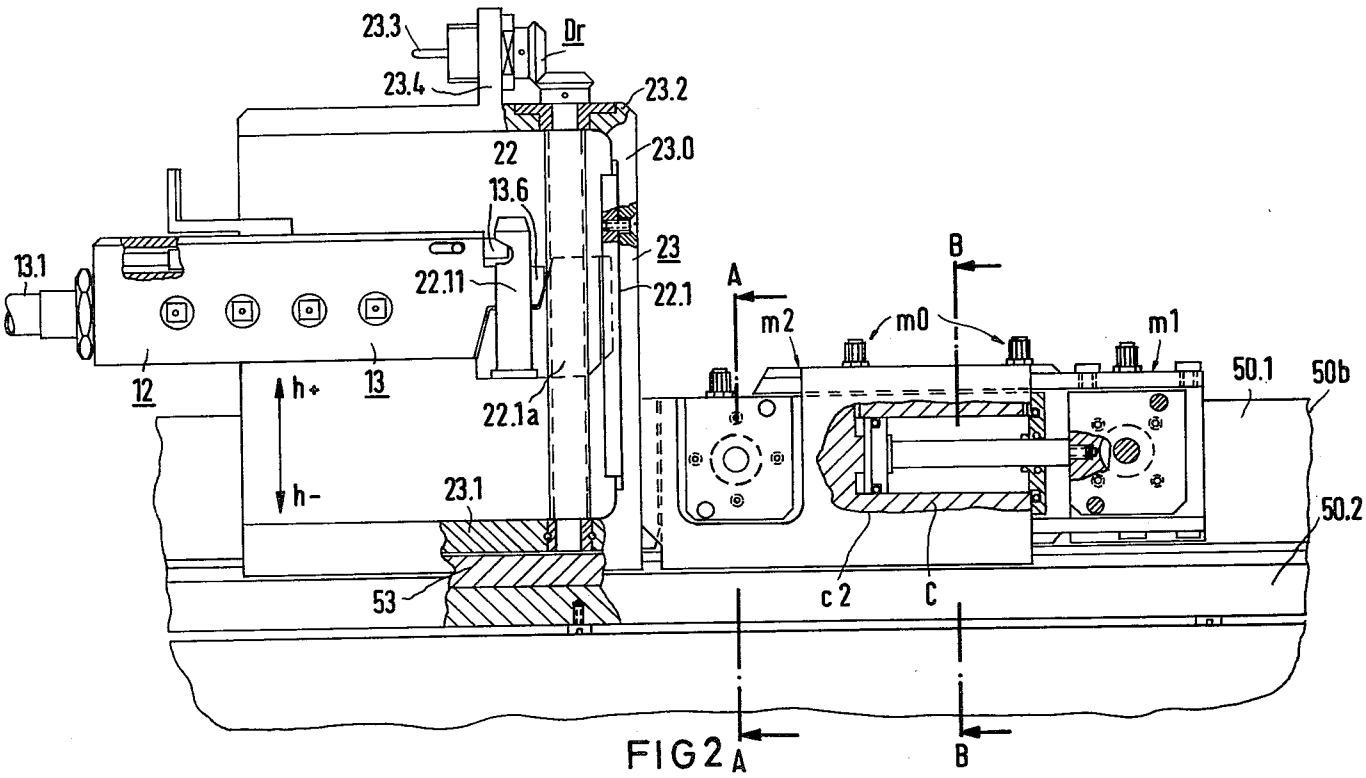
FIG. 2 is a fragmentary side-elevational view, partly broken away and in cross section of the device of FIG. 1.
Figure 3:
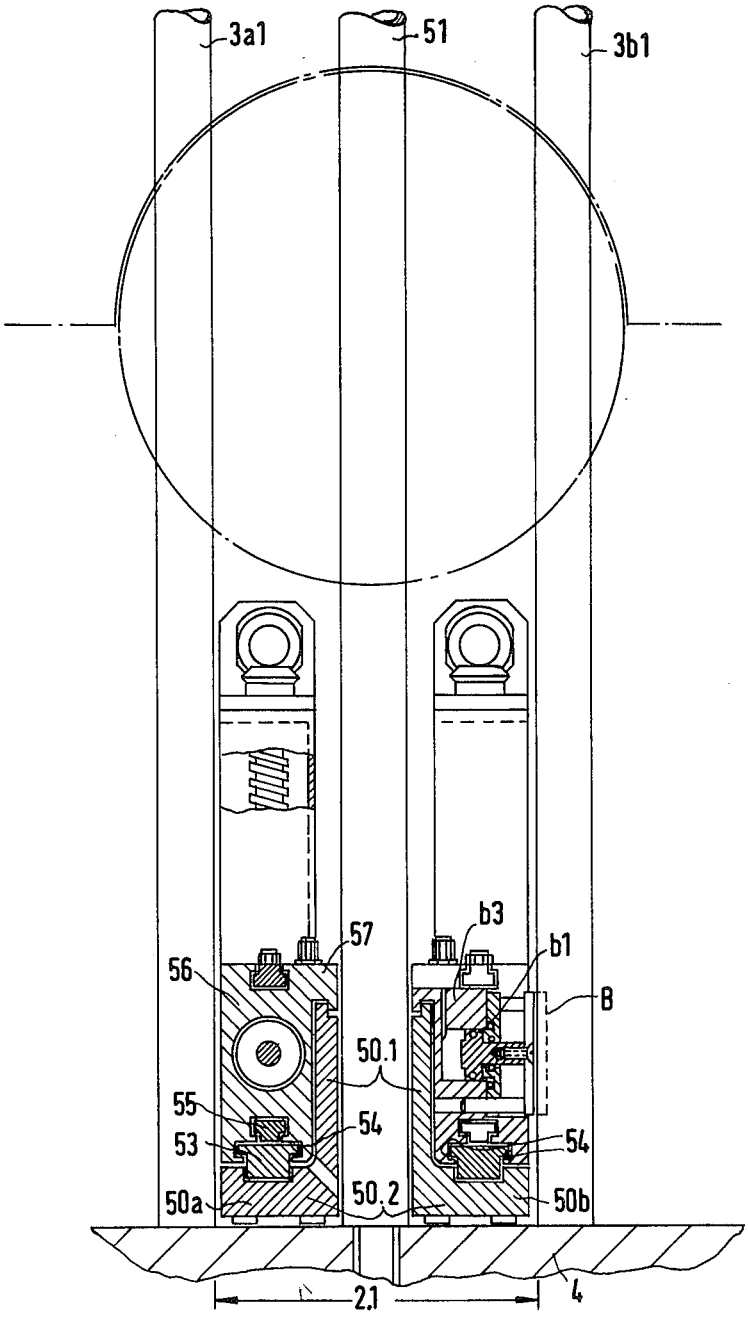
FIG. 3 is a fragmentary cross-sectional view taken along the line A—A in FIG. 2 in the right half of FIG. 3 and taken along the line B—B in FIG. 2 in the left half of FIG. 3.
Figure 4:
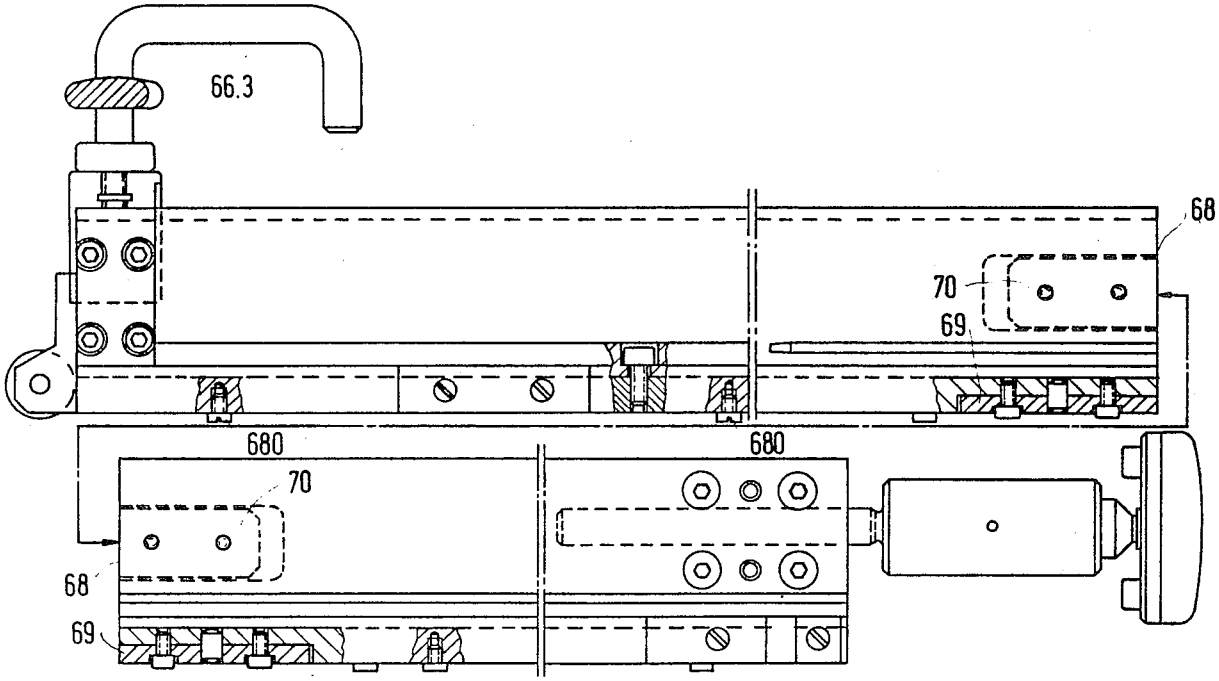
FIG. 4 is a side-elevational and partly cross-sectional view of a U-rail body.
Figure 5:
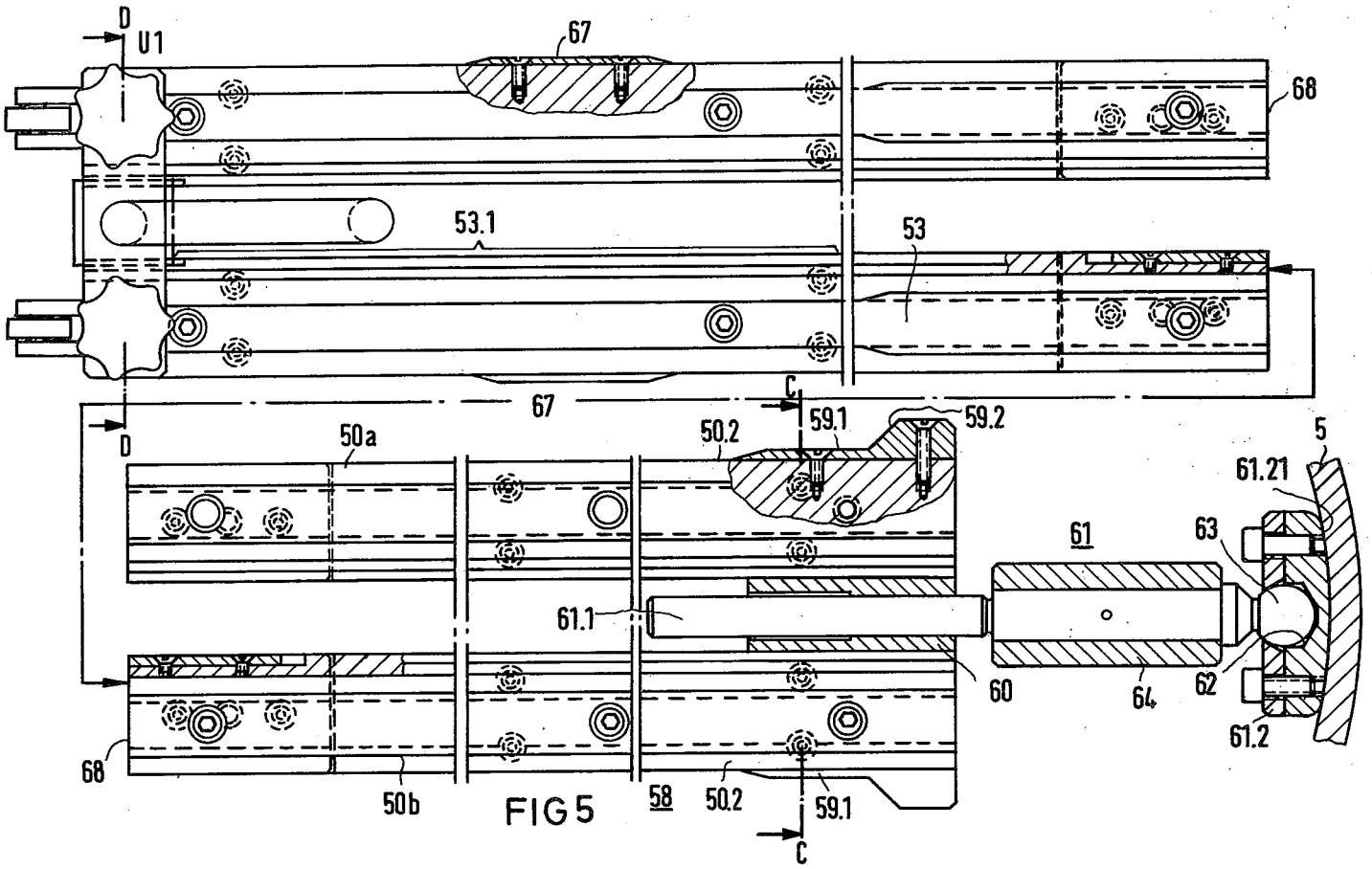
FIG. 5 is a top plan and partly cross-sectional view of the U-rail body in which the two individual guide rails that are coupled to each other are shown.

FIG. 3 shows a portion of the tube sheet 4 of the steam generator housing which forms a substantially hollow cylindrical pressure tank and a portion 5 of the wall thereof is shown in FIG. 5. Each of the individual manipulators 1*a*, 1*b* includes a vehicle m0, an elevator member 23 coupled thereto and a spraying head 13 which is supported on the elevator member 23 so as to be adjustable in height. The spraying head 13 includes spraying nozzles which are generally designated with reference numeral 12 and are designated in detail with reference numerals 12.1*a*, 12.1*b*, 12.1*c* and 12.1*d*, as seen in particular in FIGS. 1 and 2.

The vehicle m0 is a stepping mechanism which is formed of two stepping mechanism members that are movable relative to each other in the feed direction v, namely a first mechanism m1 on the front, and a second mechanism m2 on the back. The stepping mechanism m1 on the front of the manipulator 1*a* has a clamping leg k1*a*, and the rear stepping mechanism m2 has a clamping leg k2*a*. The corresponding clamping legs of the second manipulator 1*b* in the vehicle m0 are designated with reference numerals k1*b* and k2*b*. The pairs of clamping legs k1*a*, k2*a* and k1*b*, k2*b* are shown in the withdrawn position, in which they just rest against the heat exchanger tubes 3' of the frontal clamping plane a—a and the rearward clamping plane b—b with concave base portions fitting the contour of the heat exchanger tubes. The concave base portions are designated with reference numeral 52. In order to actuate the clamping legs, generally designated with reference symbol k, pneumatic piston/cylinder systems A (stepping mechanism member m1) and B (stepping mechanism members m2), are provided. An abutment for the pneumatic locking of the vehicle m0 or its stepping mechanism members m1, m2 at the heat exchanger tube 3' is formed by a vertical leg 50.1 of the guide rails 50*a*, 50*b* which have an L-shaped profile. The vehicle m0 rests against the abutment with its long side facing away from the rows of tubes, as will be explained in greater detail below.

The vehicle also includes a feed motor C which is also formed of a piston/cylinder system, wherein a cylinder c2 is connected to the stepping mechanism member m2 and a piston c1 of the feed motor C is connected to the stepping mechanism member m1 on the front, as seen particularly clearly in FIG. 2. The piston-cylinder systems A, B and C of the vehicles m0 of the two manipulators 1*a*, 1*b* can each be acted upon from both sides; they are explained in detail in U.S. application Ser. No. 460,859, so that a detailed explanation can be dispensed with herein. It should merely be mentioned that the tensioning pistons are designated with reference symbols a1, b1 and the corresponding cylinders are designated with reference symbols a3, b3, for the piston/cylinder systems A of the clamping plane a—a and B of the clamping plane b—b. The vehicles m0 can advance in the feed direction v if, when locked in the clamping plane b—b, the clamping legs k1*a*, k1*b* of the clamping plane a—a are released, i.e., pulled in, and the feed motor C is activated so that its piston c1 with the stepping mechanism member m1 connected thereto on the front is extended. Specifically, in this case, the mechanism m1 is extended by two tube pitch divisions t to a clamping plane a1—a1 indicated by broken lines. Then the clamping legs k1*a* of the manipulator 1*a* or the clamping legs k1*b* of the manipulator 1*b* are extended and the stepping mechanism member m1 is locked in this way. The clamping legs k2*a*, k2*b* of the clamping plane b—b of the stepping mechanisms m2 are therefore released and these rearward stepping mechanism members m2 can be pulled along in the feed direction v by activating the feed motor C in the other direction. The feed in the direction −v would logically take place in the reverse sequence.

According to a preferred embodiment, both manipulators 1*a*, 1*b* are advanced simultaneously, so that during the spraying process in the respective spraying position, they operate like the manipulator according to U.S. application Ser. No. 460,859 with the dual spraying head. In principle, it would also be possible to move the individual manipulators 1*a*, 1*b* through the tube lane 2 independently of each other and/or physically shifted relative to each other.

Each of the manipulators 1*a*, 1*b* has the above-mentioned elevator member 23 on the spraying head side of the vehicle m0. The elevator member is formed of a vertical frame with bearing plates 23.1, 23.2 on the bottom and top thereof, a vertical spindle 22 rotatably supported in the bearing plates, a support body 22.1 which is supported with a traveling nut part 22.1*a* on the spindle in such a way as to be secured against rotation and adjustable in height, and a rotary drive which is associated with one of the spindle ends and is designated as a whole with reference symbol Dr.

The spraying head 13 is hung through the use of a hinge projection 13.6 on a post 22.11 of the support body 22.1; the spraying head is supported with positive engagement of its hinge projection on the correspinding support surfaces of the support body 22.1. This support of the spraying head permits quick assembly and disassembly. By actuating the rotary drive Dr, the spraying head 13 can therefore be moved upward in the direction of the arrow h+ similar to an elevator or downward in the direction of the arrow h−, in order to adapt the device to the different heights of scum or sediment piles on the tube sheet. These scum piles are generally sprayed away while progressing from the top to the bottom. The spray pressure is in the range of between 100 and 220 bar and preferably, at about 200 bar, as discussed in U.S. application Ser. No. 460,859. In general, three different types of spraying heads 13 are used: the 90°-nozzles or spraying heads 12.1, the 30°-nozzles or spraying heads, as well as the 150°-nozzles or spraying heads which spray into the tube grid lanes in the directions designated with reference numerals 15.1, 15.2 and 15.3, respectively, indicated by dot-dash lines.

The fast coupling between the elevator member 23 and the vehicle m0 is accomplished by a dovetail-shaped projection 21.1 at the vertical frame portion 23.0 of the elevator member 23 and a corresponding dovetail-shaped slot at the rearward end face of the stepping mechanism member m2.

The rotary drive Dr has an angle transmission formed by miter gears, in which a long drive crank can be coupled to the shaft of the driving miter gear supported in a vertical side plate 23.4 through a coupling pin 23.3 thereof for remote-control adjustment. However, a drive motor fastened to the frame of the elevator member 23 could also be provided.

FIG. 2 and in particular FIG. 3, show longitudinal keys 53 having an approximately T-shaped cross section, which are worked into the horizontal leg 50.2 of the L-shaped guide rails 50*a*, 50*b*. The keys 53 may be formed of precisely machined brass. The keys serve for the precise guidance of the manipulators 1*a*, 1*b* by virtue of the fact that the manipulators extend over the longitudinal key 53 with the lateral surfaces of a longitudinal slot 54 having a similarly approximately T-shaped cross section. As seen in FIG. 3, disposed above the longitudinal key 53 is a guiding arm 55, which points in the feed direction, is fastened to the rear stepping mechanism member m2, has an approximately T-shaped cross section and engages a correspondingly T-shaped longitudinal slot formed in the stepping mechanism member m1 on the front, which is likewise precisely guided in this manner without itself being in engagement with the longitudinal key 53.

The manipulators 1*a*, 1*b* described with reference to FIGS. 1 to 3 serve for the high-pressure blowdown of heat exchangers in general and for the region of the tube sheet of the steam generators of nuclear power stations in particular. Such steam generators, preferably those of the U-tube bundle type, have tube lanes 2 between the two tube bundles and they have closeable service openings such as hand holes in the wall of the steam generator which allow access to these tube lanes. Therefore, at least one manipulator 1*a* or 1*b* can be inserted into the tube lane 2 or into the sublanes 2*a*1, 2*a*2 through these non-illustrated service openings, and this manipulator can be moved and positioned within the tube lane 2 in such a manner that the spray jets of its spraying head 13 can be directed into the tube grid interspaces in the directions 15.1, 15.2, 15.3. The spraying liquid is so-caled deionate, which is specially processed water with a given electric conductivity. The collected blowdown water is pumped off again by non-illustrated suction nozzles as explained in detail in U.S. application Ser. No. 460,859. The nozzles 12 of this spraying head 13 can be positioned in their spray position for a spray position sequence extending over the largest part of the tube lane 2, by virtue of the provision that the respective vehicle m0 can be clamped with its extendable and retractable clamping legs k to the tubes of the tube lane sides 2*a* and 2*b* in conformance with the tube pitch. The mouths of the spraying nozzles as well as their distance from the clamping planes a—a, b—b of the clamping legs k are matched to the tube pitch in such a way that the spray jets enter into the spaces between the tubes.

Special guide rails 50*a*, 50*b* are provided which allow precise guidance of the manipulators with effective spraying in the closest quarters, especially for tube lanes with internal components in the center of the tube lanes, such as in the form of the tie rods 51 as shown. As shown, at least one guide rail 50*a* or 50*b* having an approximately L-shaped cross section is provided, the vertical leg 50.1 of which faces away from the next-adjacent tube row 3*a*1 or 3*b*1. A lower base body 56 of the vehicle m0 of the manipulator 1*a*, 1*b* having an approximately rectangular cross section, is inserted into a space which is defined by the two L-shaped legs, the vertical leg 50.1 and the horizontal leg 50.2 which is fastened to the tube sheet 4 after being adjusted, and is limited in width by the next-adjacent row of tubes 3*a*1 and 3*b*1, respectively. This base body 56 belongs to the rearward stepping mechanism member m2. As already explained, this base body 56 is generally provided with projections or setbacks on the bottom and/or on the side adjacent the vertical L-shaped leg 50.1, through which it is guided with a sliding fit in the feed direction v at corresponding setbacks and projections of the horizontal and/or vertical L-shaped leg 50.2, 50.1 of the guide rail generally designated with reference numeral 50. On the bottom, this guide for the base body 56 and therefore for the manipulator 1*a*, 1*b* including the elevator member 23, is formed of the guiding engagement between the already mentioned longitudinal key 53 and the lateral surfaces of the longitudinal slot 54 on the bottom, which has a T-shaped cross section, like the longitudinal key. The base body 56 additionally has a projection 57 disposed in the upper portion of one of its lateral surfaces which extends over the upper end of the vertical L-shaped leg 50.1 and has trapezoidal gears formed therein at this upper end in the form of a slot-and-key guide and is guided in the feed direction with a sliding fit.

As already indicated, a guide rail 50*a*, 50*b* of approximately L-shaped cross section is installed inside the two tube sublanes 2*a*1, 2*b*1, forming a double rail, the vertical L-shaped legs 50.1 of which face each other. One of the identical individual vehicles m0 each of the manipulators 1*a*, 1*b*, is guided on a single guide rail, sliding in the feed direction v (or −v, respectively). The clamping feet k of the two individual vehicles m0 each point away from the vertical central plane (axis 2') laterally outward to the adjacent row of tubes 3*a*1 and 3*b*1 of the heat exchanger and can be extended in this direction. Accordingly, the nozzles 12 of the spraying heads 13 associated with an individual vehicle m0 also point away from the central plane and can be aligned relative to the spaces in the direction 15.1 between the tubes of the two tube bundle halves 3*a*, 3*b*, and with the nozzle heads changed, they can be aligned relative to the interspaces in the directions 15.2, 15.3.

Figure 6:
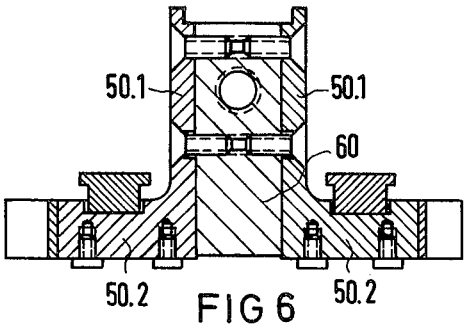
FIG. 6 is a cross-sectional view taken along the line C—C in FIG. 5, showing the region of the tensioning device with the connecting piece and positioning spindle thread.

FIG. 5 shows especially clearly that the two guide rails 50*a*, 50*b* are joined together in a twin arrangement at one end U2 to form an elongated U-rail body (as seen in a top view). The two guide rails 50*a*, 50*b* have dogs 59 provided with seating surfaces 59.1 parallel to the axis and with inclined clamping surfaces 59.2, in the joined region on the outside of their horizontal L-shaped legs 50.2, facing away from each other. The distance between the clamping surfaces 59.2 in this case exceeds the width 2.1 of the tube lanes shown in FIG. 1. The vertical L-shaped legs 50.1 of the two guide rails 50*a*, 50*b* are furthermore fastened in the joined region to a rectangular connecting piece 60, as also seen in FIG. 6. This connecting piece 60 serves as the support for a clamping device 61. The clamping device 61 has an adjusting spindle 61.1 which is supported in a corresponding tapped hole in the connecting piece 60 and can be screwed in and out with a pressure piece 61.2 at its free end. In this manner, the U-rail body 58 which is inserted into the tube lane 2 from the right end, circumventing the tie rods 51, rests with its dogs 59 against the end tubes of the first two rows of tubes 3*a*1, 3*b*1 and can be clamped by tightening the adjusting spindle 61.1 at the heat exchanger wall 5. This is done with the pressure piece 61.2 on one hand and by means of the inclined surfaces 59.2 on the other hand. They can also be positioned in the desired relationship relative to the rows of tubes.

The pressure piece 61.2 is spherically adjustably supported at the free end of the spindle 61.1 and has a spherical contact surface 61.21. A corresponding joint seat 62 in the interior of the pressure piece 61.2 extends over a sphere 63 at the free end of the spindle 61.1 for this purpose. The threaded shaft of the spindle 61.1 is followed by a cylindrical handle 64 provided with a knurl, so that the spindle 61.1 can be readily moved by hand.

Figure 7:
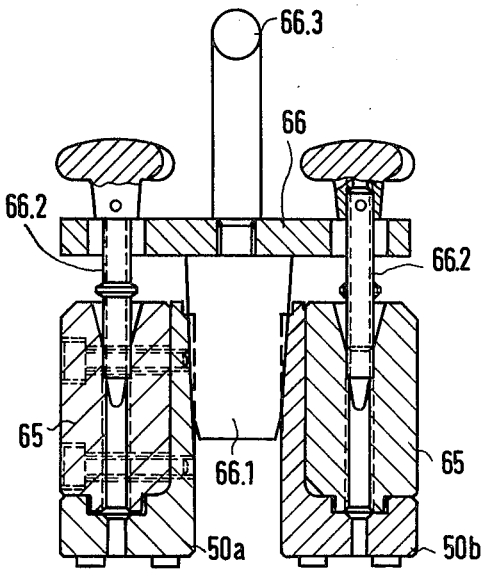
FIG. 7 is a cross-sectional view taken along the line D—D in FIG. 5, showing the coupling plate with adjusting wedge, adjusting screws and bracket handle.

At the other normally open end of the U-rail body 58, threaded blocks 65 are fastened to the guide rails 50*a*, 50*b*, as seen in FIG. 7; they complete the I-shaped profile of the guide rail 50*a*, 50*b*, forming an approximately rectangular profile. A coupling plate 66 provided with an adjusting wedge 66.1 can be inserted with its adjusting wedge between the two guide rails 50*a*, 50*b*, as shown, and can be tightened by means of setscrews 66.2 on the threaded blocks 65. This is done in such a manner that the guide rails 50*a*, 50*b*, come into contact with at least a second pair 67 of contact surfaces which is disposed near the open end of the U-rail body on the sides of the horizontal L-shaped legs 50.2 facing away from each other, against heat exchanger tubes 3' of the first row of tubes 3*a*1 and 3*b*1, respectively, adjacent the tube lane 2.

In this manner, the position of the U-rail body 58 with respect to the adjoining first rows of tubes 3*a*1, 3*b*1 is fixed without play. The defined horizontal position is determined because cylinder screws 680 screwed-in at the underside of the horizontal L-shaped legs 50.2 are ground off to a uniform dimension. Thus, the U-rail body 58 rests on the tube sheet in a defined manner if it is flat. In order to align the U-rail body, two pairs of contact surfaces are sufficient, namely, 67,67 at the left end and 59.1,59.1 at the right end.

For better handling, the coupling plate 66 is provided with a handle bracket 66.3. The handling of the rail system is further facilitated if the individual guide rails 50*a*, 50*b* are cross-divided into at least two rail parts and have a rail joint 68 at approximately half their length for this purpose. In vicinity of this rail joint 68 at the bottom and laterally at both rail halves, respective recesses are provided for receiving coupling plates 69 and 70 which are bolted and pinned to the rail ends.

In order to set the manipulator or manipulators 1*a*, 1*b* on the rails, the T-shaped legs of the T-shaped profile of the longitudinal keys 53 are omitted at least on one vehicle length in the mounting region near the open end U1 of the U-rail body 58 (the closed end thereof being designated with reference symbol U2), and specifically on the length 53.1 seen in FIG. 5. This is done so that the vehicles m0 can be put on the rail on this longitudinal key 53 with their longitudinal slot 54 which has a T-shaped cross section and, if pushed along, can extend behind the T-shaped profile of the longitudinal key 53. The manipulators 1*a*, 1*b* are set on the rails through a suitable hand hole if the U-rail body 58 is adjusted at its end U1 by means of the coupling plate 66. After the spraying operations are completed (the high-pressure spray hose is further designated in FIGS. 1 and 2 with reference numeral 13.1), the manipulators 1*a*, 1*b* are returned to their starting position in the vicinity of the end U1 and are disassembled. Similarly, the U-rail body is disassembled in the reverse order as described and removed from the tube lane through the hand holes.

The foregoing is a description corresponding in substance to German Application No. P 33 01 536.8, dated Jan. 19, 1983, the International priority of which is being claimed for the instant application, and which is hereby made part of this application. Any material discrepancies between the foregoing specification and the aforementioned corresponding German application are to be resolved in favor of the latter.

We claim:

1. Tube lane manipulator assembly for the high-pressure blowdown of heat exchangers of steam generators having tubes disposed in rows and spaced apart in a tube grid by a given tube pitch defining interspaces therebetween, tube lanes disposed between the rows of tubes and service openings providing access to the tube lanes, comprising a manipulator, at least one vehicle disposed on said manipulator having a lower base body with a substantially rectangular cross section, a spraying head with nozzles being disposed on said vehicle, said vehicle being insertible into the tube lanes through the service openings and being movable in the tube lanes by remote control in a given feed direction, said spraying head being movable into position for spraying jets directed into the interspaces, at least two extendable and retractable clamping legs disposed in tandem in said feed direction on a side of said vehicle for clamping said vehicle to the tubes in conformity with the tube pitch in a clamping plane on at least one side of a tube lane for positioning said nozzles in respective spraying positions of a spraying position sequence, the spraying direction of said nozzles and the distance thereof from said clamping plane being matched to the tube pitch for directing the spray jets into the interspaces, and at least one guide rail extended along said feed direction within a tube lane forming an abutment for said clamping legs and a guide for said vehicle, said guide rail having a substantially L-shaped cross section with a vertical leg facing away from the row of tubes closest to the tube lane and a horizontal leg defining a space between said legs being limited in width by the row of tubes closest to the tube lane for receiving said lower base body of said vehicle.

2. Tube lane manipulator assembly according to claim 1, including internal components decreasing the width of the tube lanes.

3. Tube lane manipulator assembly according to claim 1, wherein said manipulator has relatively longer and relatively shorter sides, and the tubes are accessible to said clamping legs from only one long side of said manipulator.

4. Tube lane manipulator assembly according to claim 2, wherein said manipulator has relatively longer and relatively shorter sides, and the tubes are accessible to said clamping legs from only one long side of said manipulator.

5. Tube lane manipulator assembly according to claim 1, including suction nozzles and suction lines for pumping off accumulated blowdown water.

6. Tube lane manipulator assembly according to claim 1, wherein said base body of said vehicle has a lower surface and a surface adjacent said vertical leg of said guide rail, one of said surfaces having projections formed thereon and one of said legs of said guide rail having indentations formed therein sliding on said projections in said feed direction.

7. Tube lane manipulator assembly according to claim 1, wherein said base body of said vehicle has a lower surface and a surface adjacent said vertical leg of said guide rail, one of said surfaces having indentations formed therein and one of said legs of said guide rail having projections formed thereon sliding on said indentations in said feed direction.

8. Tube lane manipulator assembly according to claim 1, wherein said horizontal leg of said guide rail has an upper surface with a longitudinal key having a T-shaped profile integral with said upper surface, and said base body of said vehicle has a lower surface with a longitudinal slot with a T-shaped cross section formed therein and extended over said T-shaped profile.

9. Tube lane manipulator assembly according to claim 8, wherein said base body of said vehicle has a projection integral with an upper region of a lateral surface thereof, said projection being extended over the top of said vertical leg of said guide rail, and said projection having a slot formed therein for sliding on said vertical leg in the feed direction in the form of a slot and key guide.

10. Tube lane manipulator assembly according to claim 1, including internal components dividing the tube lane along a vertical central plane into two tube lane halves, said at least one guide rail being in the form of two guide rails with L-shaped cross sections each being disposed in a respective one of said tube lane halves forming a double rail with vertical legs facing each other, said at least one vehicle being in the form of two identical vehicles each being slidable on a respective one of said guide rails in said feed direction, said clamping legs of said vehicles being extendable away from said central plane laterally outwardly toward the row of tubes closest to the tube lane, and said nozzles of said spraying heads being movable laterally away from said central plane into alignment toward the interspaces.

11. Tube lane manipulator assembly according to claim 10, wherein the steam generator includes a tube sheet, and said internal components are tie rods disposed in the center of the tube lane, extended parallel to the tubes and anchored in said tube sheet.

12. Tube lane manipulator assembly according to claim 10, wherein the heat exchanger has a wall with an inner surface, the tubes include end tubes, said two guide rails are joined together at an end region thereof to form an elongated U-rail body, as seen from the top, said two guide rails have dogs disposed on outer surfaces of said horizontal legs thereof in said end region facing away from each other, and said dogs have axially parallel fitting surfaces and inclined clamping surfaces, said clamping surfaces being spaced apart by a distance exceeding the width of the tube lane, including a rectangular connecting piece fastened to said vertical legs of said guide rails of said U-rail body in said end region, a clamping device supported by said connecting piece, an adjusting spindle disposed on said clamping device, a pressure piece disposed on a free end of said adjusting spindle, said adjusting spindle being supported in and being able to be screwed in and out of said connecting piece, said U-rail body being insertible into the tube lane from one end thereof resting with said dogs against the end tubes of the two rows of tubes closest to the tube lane and being clampable by tightening said adjusting spindle at said heat exchanger wall between the end tubes and the inner surface of the wall of the heat exchanger, and being movable into a desired position relative to the rows of tubes.

13. Tube lane manipulator assembly according to claim 12, wherein said pressure piece has a spherical contact surface and is spherically adjustably supported at the free end of said adjusting spindle.

14. Tube lane manipulator assembly according to claim 12, wherein said U-rail body has an open end, including at least one pair of contact surfaces disposed on sides of the horizontal legs facing away form each other in vicinity of said open end of said U-rail body, threaded blocks fastened to said guide rails at said open end of said U-rail body, a coupling plate having an adjusting wedge insertible between said two guide rails, and set screws for tightening said adjusting wedge to said threaded blocks bringing said guide rails into contact with the tubes of the rows of tubes closest to the tube lane with said contact surfaces.

15. Tube lane manipulator assembly according to claim 13, wherein said U-rail body has an open end, including at least one pair of contact surfaces disposed on sides of the horizontal legs facing away from each other in vicinity of said open end of said U-rail body, threaded blocks fastened to said guide rails at said open end of said U-rail body, a coupling plate having an adjusting wedge insertible between said two guide rails, and set screws for tightening said adjusting wedge to said threaded blocks bringing said guide rails into contact with the tubes of the rows of tubes closest to the tube lane with said contact surfaces.

16. Tube lane manipulator assembly according to claim 14, including a handle bracket disposed on said coupling plate.

17. Tube lane manipulator assembly according to claim 15, including a handle bracket disposed on said coupling plate.

18. Tube lane manipulator assembly according to claim 10, wherein said guide rails are cross divided into at least two rail parts, and including a rail joint substantially at the middle of the length of said guide rails, and coupling plates disposed in recesses formed in a lower and a side surface of said guide rails in vicinity of said rail joint.

19. Tube lane manipulator assembly according to claim 8, wherein said at least one guide rail is in the form of two guide rails joined together at an end region thereof to form an elongated U-rail body having an open end, said T-shaped profile of said longitudinal key being transformed into a rectangular profile in vicinity of said open end of said U-rail body over at least the length of said vehicle where said manipulator is mounted, whereby said vehicle is mountable on said longitudinal key with said longitudinal slot on said rectangular profile and is slidable onto said T-shaped profile.

* * * * *